US009248887B1

(12) United States Patent
Chang

(10) Patent No.: US 9,248,887 B1
(45) Date of Patent: Feb. 2, 2016

(54) INFLATABLE BOAT

(71) Applicant: Herry Chang, Taipei (TW)

(72) Inventor: Herry Chang, Taipei (TW)

( * ) Notice: Subject to any disclaimer, the term of this patent is extended or adjusted under 35 U.S.C. 154(b) by 0 days.

(21) Appl. No.: 14/606,236

(22) Filed: Jan. 27, 2015

(51) Int. Cl.
*B63B 7/08* (2006.01)
*B63B 5/24* (2006.01)

(52) U.S. Cl.
CPC .... *B63B 7/08* (2013.01); *B63B 5/24* (2013.01)

(58) Field of Classification Search
CPC ..... B63B 7/082; B63B 7/08
USPC ..... 114/345; 441/40
See application file for complete search history.

(56) References Cited

U.S. PATENT DOCUMENTS 3,529,312 A * 9/1970 Robinsky ..... B63B 3/08 114/354
3,577,576 A * 5/1971 Lobb ..... B63B 7/04 114/345
5,868,095 A * 2/1999 Zeromski ..... B63B 7/085 114/345
6,860,220 B2 * 3/2005 Fleming ..... B63B 7/082 114/345
8,800,466 B1 * 8/2014 Shimozono ..... B63B 1/22 114/345
2006/0096517 A1 * 5/2006 Durand ..... B63B 7/082 114/345
2009/0031941 A1 * 2/2009 Czarnowski ..... B63B 35/71 114/345
2011/0036284 A1 * 2/2011 Chon ..... B63B 7/08 114/345

* cited by examiner

*Primary Examiner* — Lars A Olson
*Assistant Examiner* — Jovon Hayes
(74) *Attorney, Agent, or Firm* — Rosenberg, Klein & Lee

(57) ABSTRACT

An inflatable boat includes a hull-bottom backing sheet member, a hull-bottom top sheet member, transom strips bonded between the hull-bottom backing sheet member and the hull-bottom top sheet member, left and right sheet members bonded to the hull-bottom backing sheet member outside the hull-bottom top sheet member to form two lateral air chambers and to have the bonding areas between the hull-bottom backing sheet member and the left and right sheet members be kept above the waterline, and a V-shaped front piece formed on the middle of the front side of the hull bottom of the inflatable boat for breaking water (waves).

9 Claims, 10 Drawing Sheets

INFLATABLE BOAT

BACKGROUND OF THE INVENTION

1. Field of the Invention

The present invention relates to inflatable technology and more particularly, to an inflatable board, which comprises a relatively larger hull-bottom backing sheet member for hull bottom, a relatively smaller hull-bottom top sheet member for hull top, transom strips bonded between the hull-bottom backing sheet member and the hull-bottom top sheet member, left and right sheet members bonded to opposing protruding side edges of the hull-bottom backing sheet member outside the hull-bottom top sheet member to form two lateral air chambers to let the bonding areas between the two opposite side edges of the hull-bottom backing sheet member and the two opposite outer side edges of the left and right sheet members be kept above the waterline of the inflatable boat, wherein the hull-bottom backing sheet member has a V-cut located in a front side thereof on the middle, and the internal margin of the V-cut is sealed with a sealing strip to form a V-shaped front piece on the middle of the front side of the hull bottom of the inflatable boat for breaking water (waves).

2. Description of the Related Art

Conventional inflatable boats commonly have the hull made by bonding plastic or rubber sheet members together to form air chambers therein for floating on water. In these conventional inflatable boats, the hull comprises a hull bottom, and two lateral air chambers bonded to two opposite lateral sides of the hull bottom. The bonding areas between the hull bottom and the lateral air chambers are disposed at the bottom side of the lateral air chamber under the waterline of the boat. If the boat is soaked in water for a long period of time, the bonded seam between the hull bottom and each lateral air chamber will break, leading to leakage. When leaks developed, an expensive maintenance work must be taken, and the lifespan of the boat can be shortened.

There are two different structures of inflatable boats commercially available, namely, the flat hull bottom type and the V-shaped hull bottom type. An inflatable boat of flat hull bottom is easy to fabricate, however, it has the drawback of bad turning flexibility. When changing the sailing direction of the boat at a high speed, the center of gravity of the hull cannot be automatically balanced, and the crew can be thrown out of the boat if the centrifugal force experienced by the crew.

A float of V-shaped hull bottom is complicated to fabricate. However, when changing the sailing direction of the boat at a high speed, due to the design of the V-shaped hull bottom, the hull will incline inwards, causing the induced centrifugal force to be set off by the V-shaped hull bottom and the buoyancy of water, and thus, the crew will not be thrown out of the boat.

The hull of an inflatable boat of either flat hull bottom type or V-shaped hull bottom type must have a certain degree of stiffness so that the hull will not be forced to deform when it withstands a thrust or the resistance of water.

In order to enhance the stiffness of the hull, a solid material can be attached to the hull bottom. A normal inflatable boat is characterized by the advantages of convenience in use, less storage occupation, no need of installation skill. Adding a solid material to the hull bottom will destruct the aforesaid three advantages.

SUMMARY OF THE INVENTION

The present invention has been accomplished under the circumstances in view. It is the main object of the present invention to provide an inflatable boat, which eliminates the use of a high-stiffness structure for the base of the hull of the boat, has the advantages of convenience in use, less storage occupation, no need of installation skill, achieves the same performance of a boat having a V-shaped hull. It is another object of the present invention to provide an inflatable boat, which provides a one-piece hull bottom design to minimize water contact area, reducing glue hydrolysis and prolonging the lifespan of the hull.

To achieve these and other objects of the present invention, an inflatable boat comprises a hull-bottom backing sheet member and a hull-bottom top sheet member, a plurality of transom strips bonded between the hull-bottom backing sheet member and the hull-bottom top sheet member, and left and right sheet members respectively bonded to the hull-bottom backing sheet member and the hull-bottom top sheet member at two opposite lateral sides to form a respective lateral air chamber. The hull-bottom backing sheet member is a one-piece member larger than the hull-bottom top sheet member for forming a hull bottom of the inflatable boat. The left and right sheet members each have an outer side edge thereof bonded to a top surface of one respective side edges of the hull-bottom backing sheet member and sealed with a respective sealing strip, and an opposing inner side edge thereof bonded to a bottom surface of one respective side edge of the hull-bottom top sheet member and internally sealed with a respective sealing strip and externally sealed with a respective sealing strip. The bonding area between the top surface of the hull-bottom backing sheet member and the bottom surface of each side edge of the hull-bottom top sheet member is sealed with a respective sealing strip. The two opposite outer side edges of the left and right sheet members are disposed above the waterline.

DETAILED DESCRIPTION OF THE PREFERRED EMBODIMENT

Figure 1:
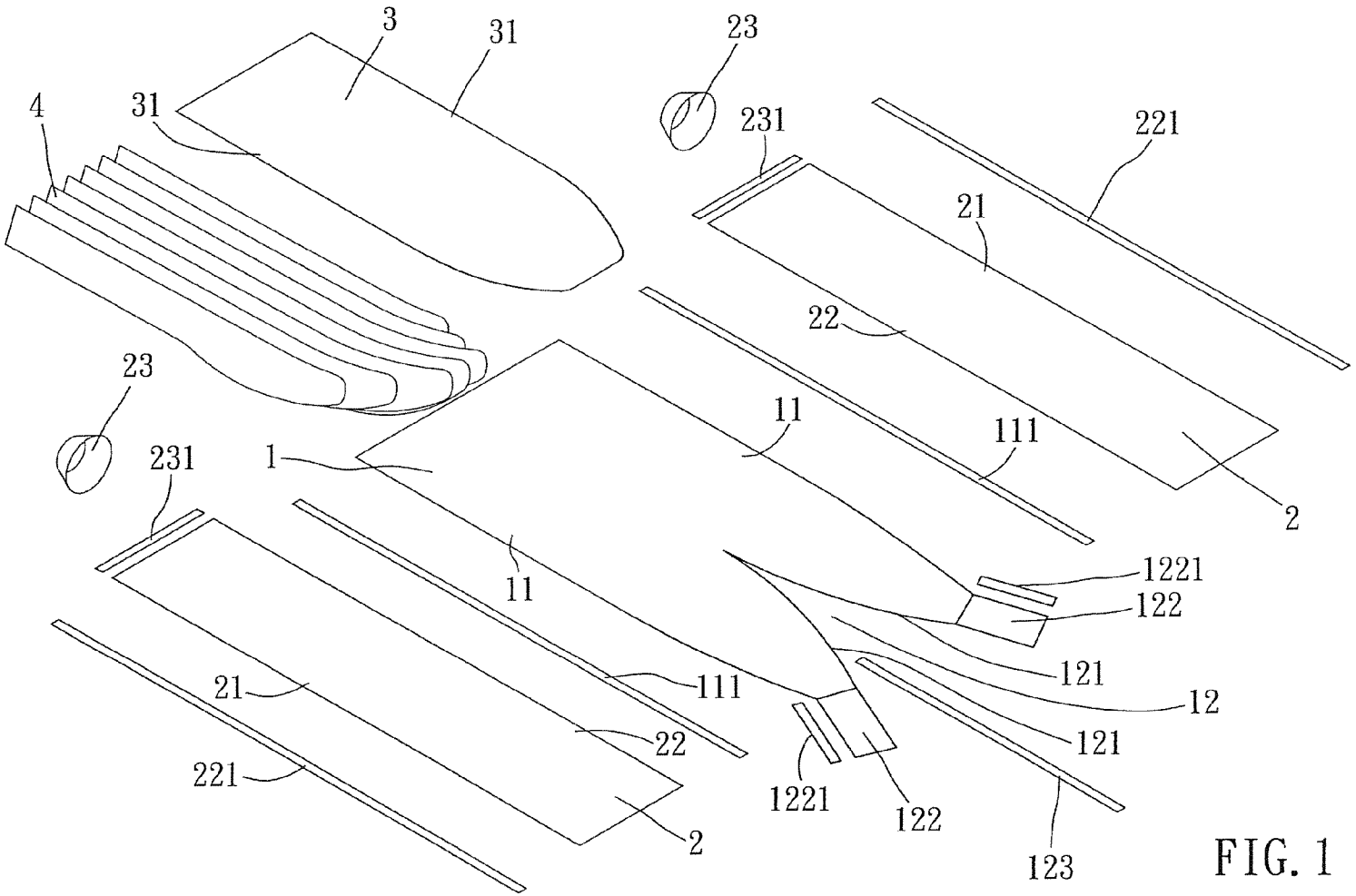
FIG. 1 is an exploded view of an inflatable boat in accordance with a first embodiment of the present invention.
Figure 2:
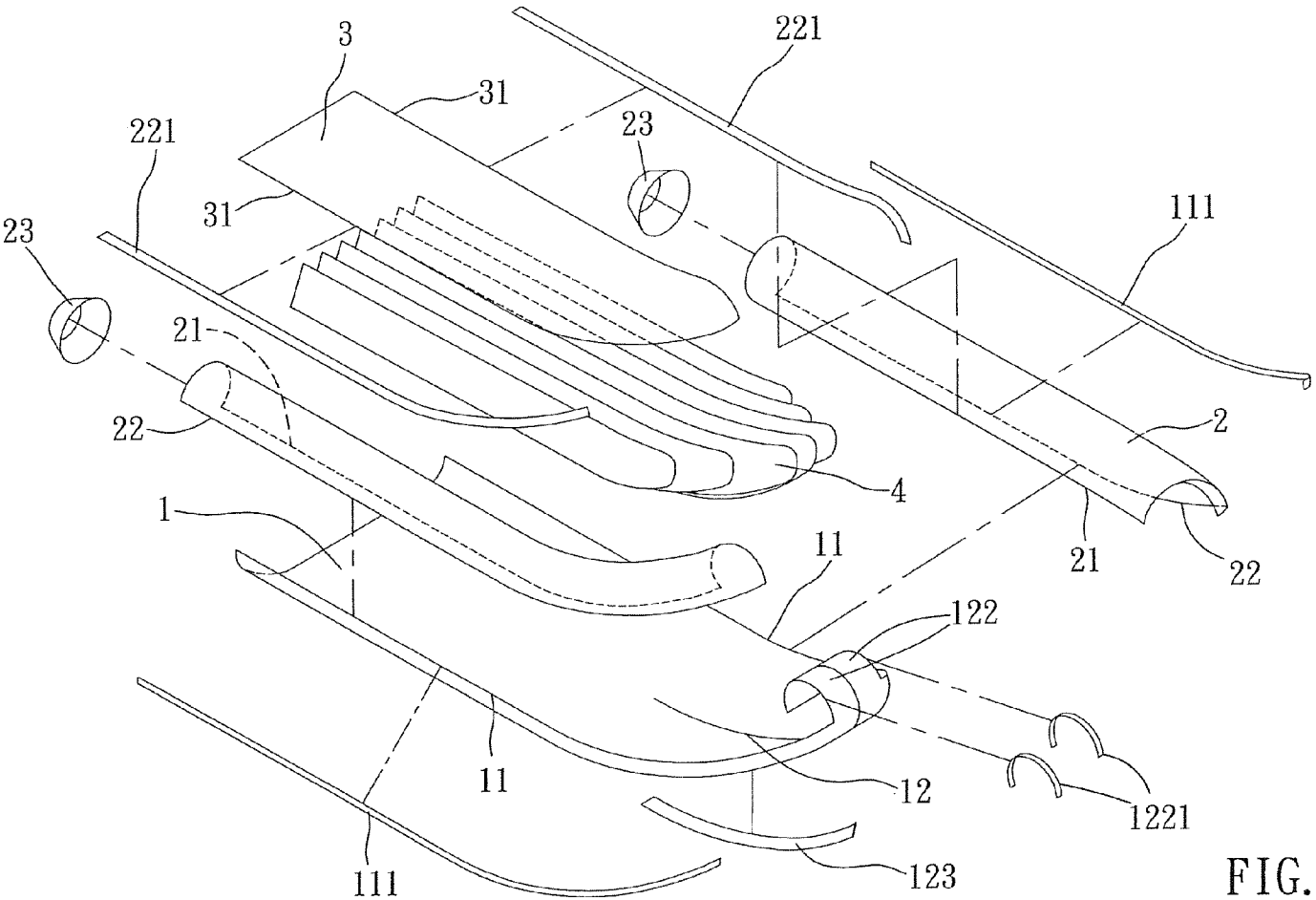
FIG. 2 corresponds to FIG. 1, illustrating a mounting status of the component parts of the inflatable boat.
Figure 3:
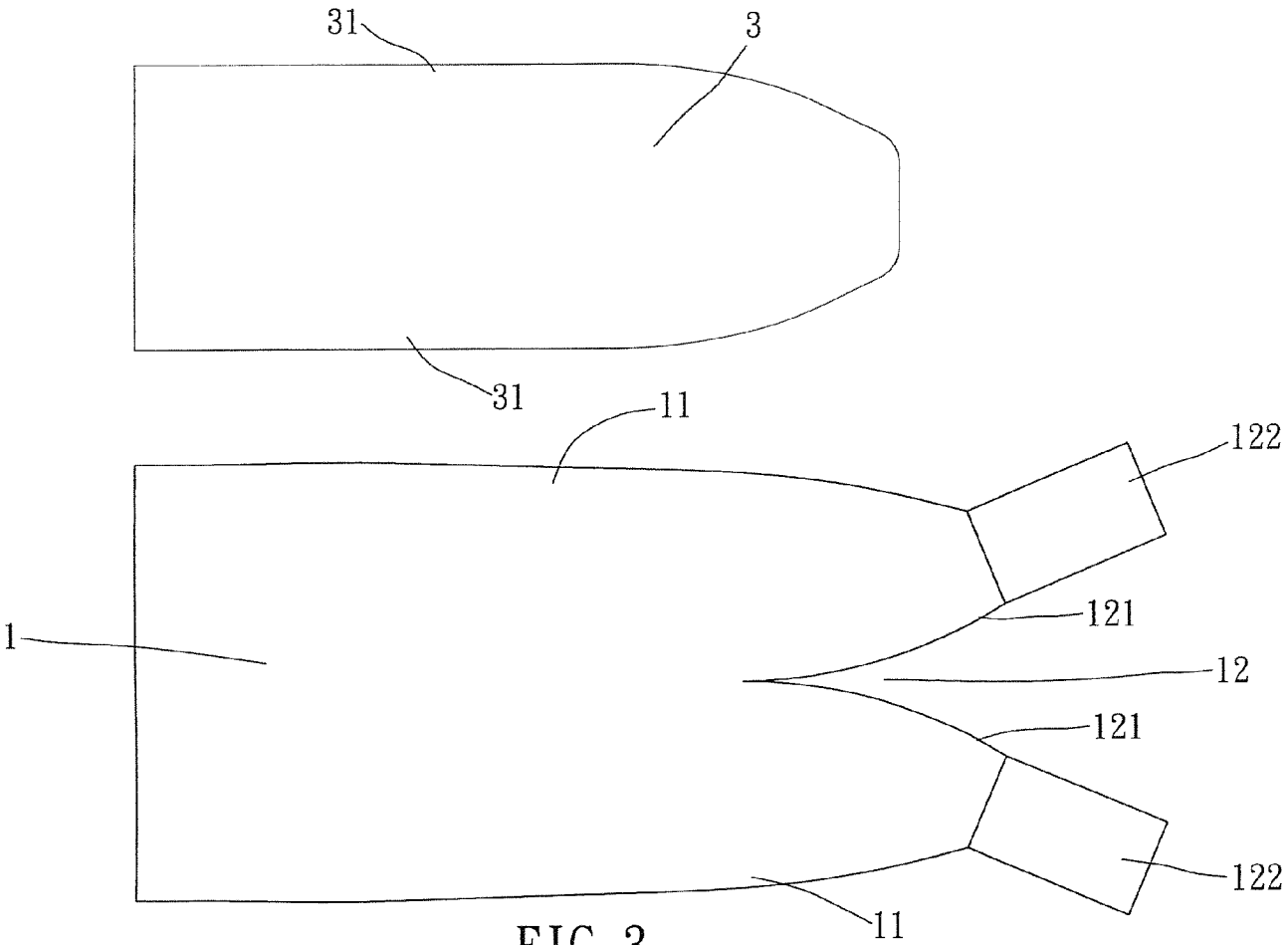
FIG. 3 is a plain view of the hull-bottom backing sheet member and the hull-bottom top sheet member of the inflatable boat in accordance with the first embodiment of the present invention.
Figure 4:
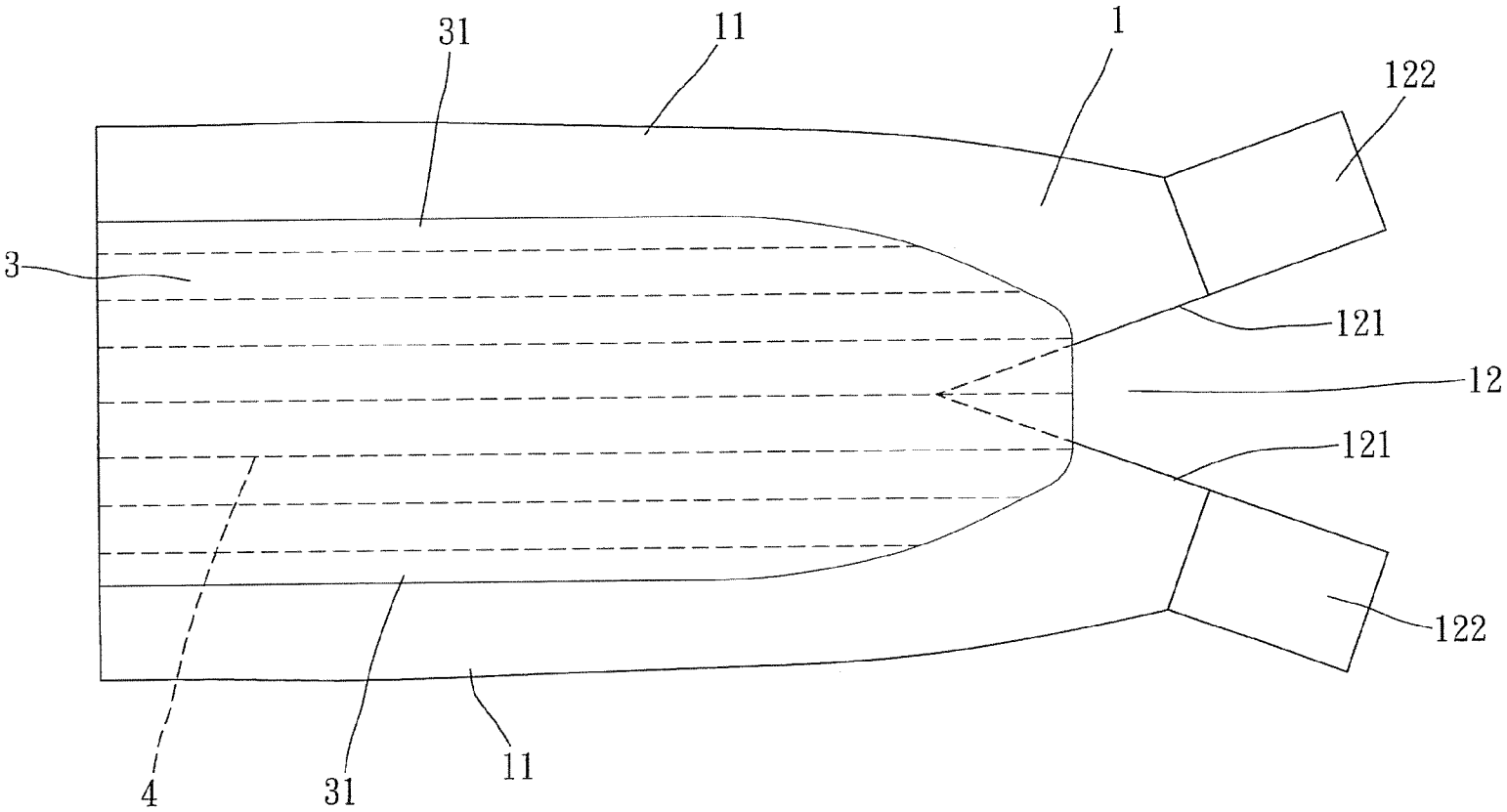
FIG. 4 is a schematic top plain view of the first embodiment of the present invention, illustrating the hull-bottom backing sheet member, the hull-bottom top sheet member and the transom strips bonded together.
Figure 5:
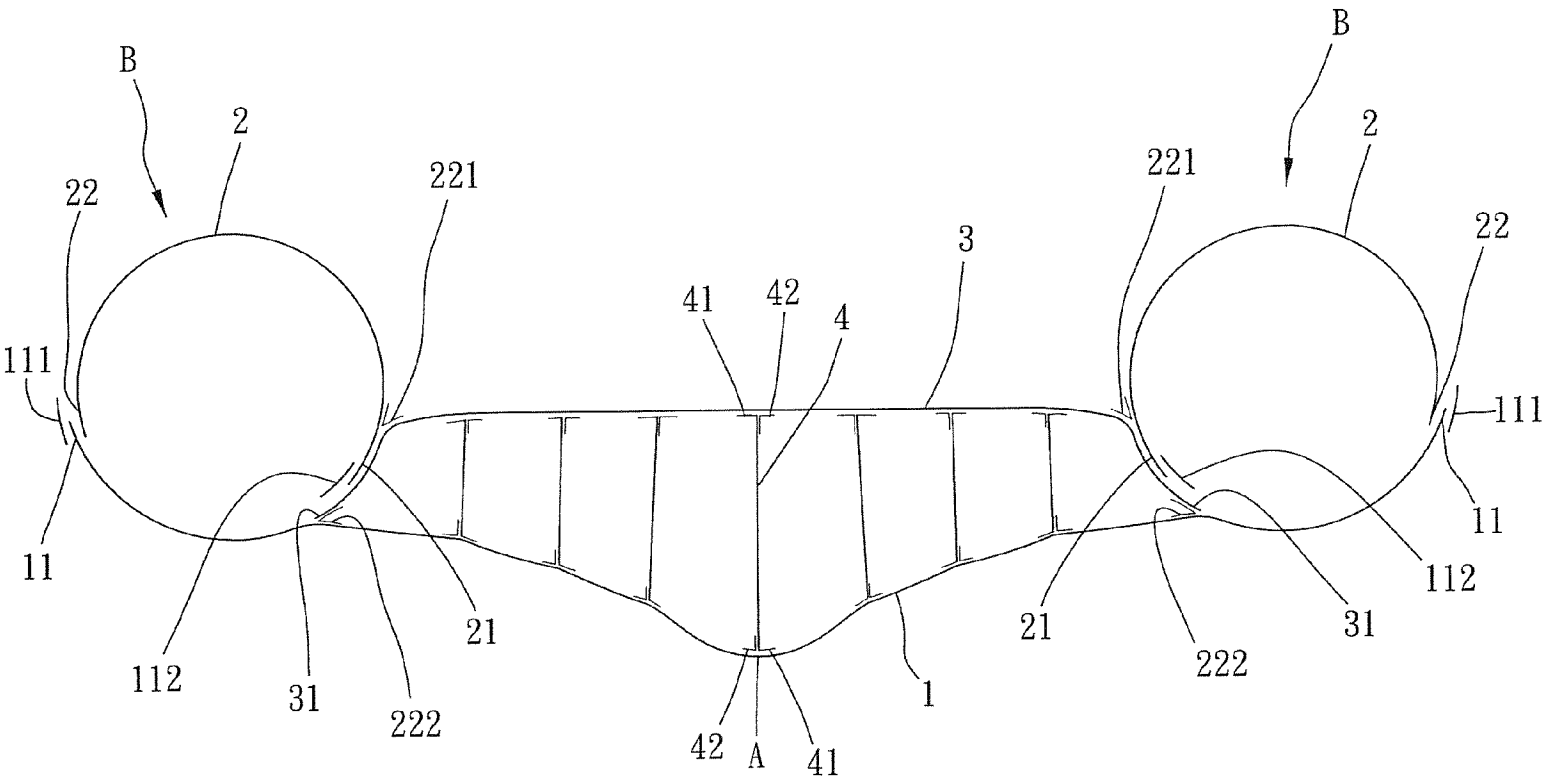
FIG. 5 is a cross sectional view of the inflatable boat in accordance with the first embodiment of the present invention.
Figure 6:
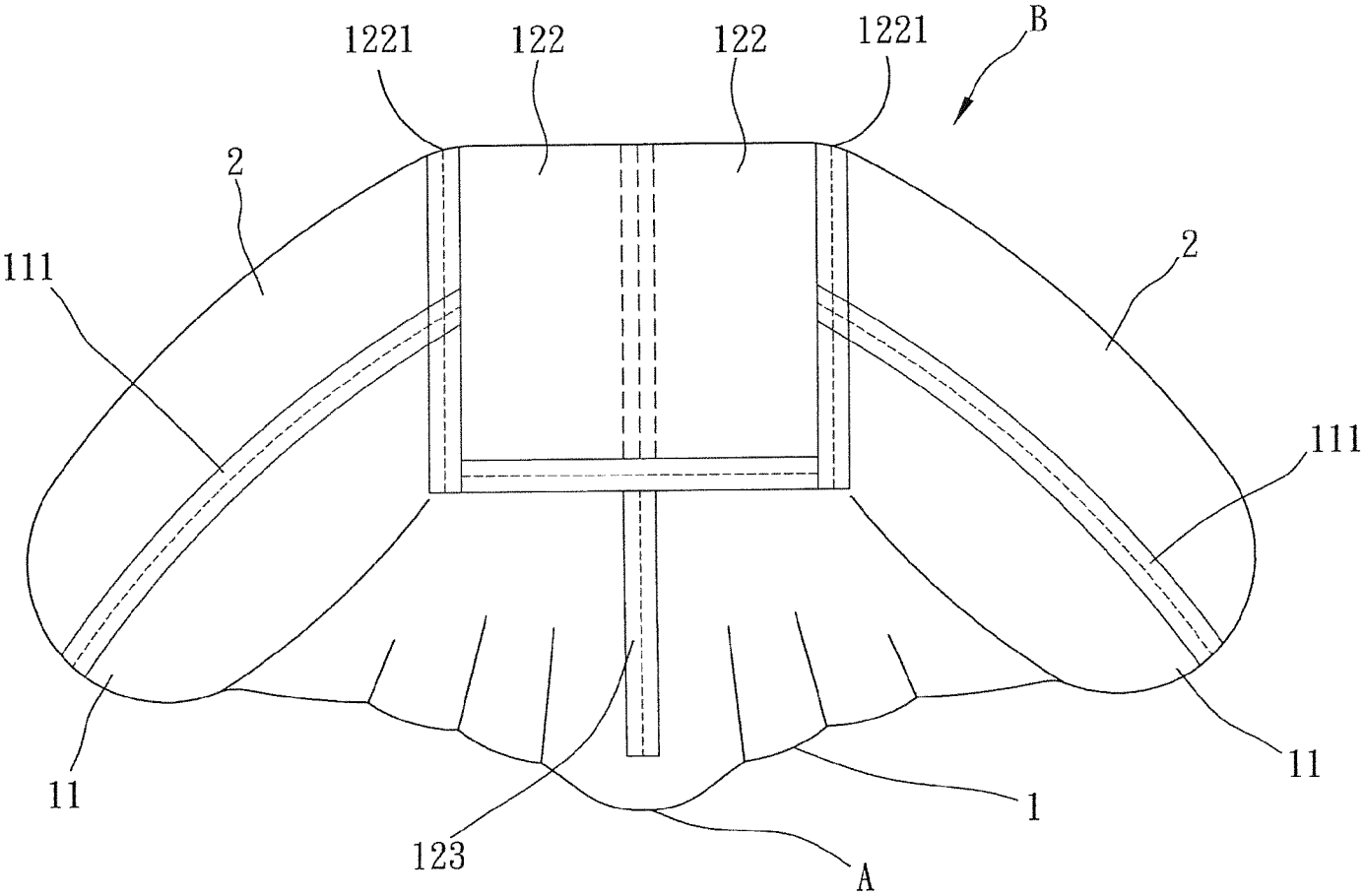
FIG. 6 is a front end view of the inflatable boat in accordance with the first embodiment of the present invention.
Figure 7:
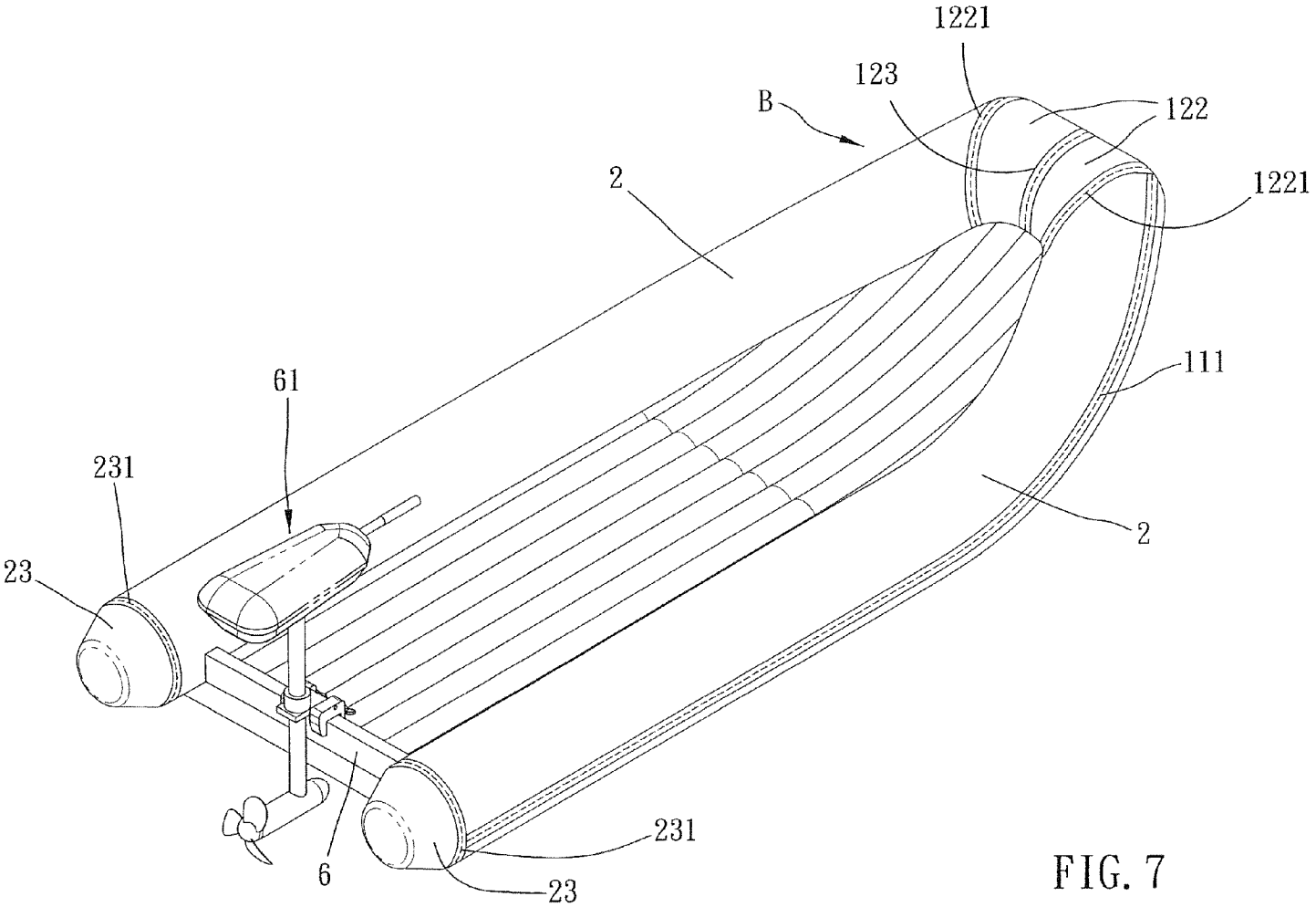
FIG. 7 is an oblique top elevational view of the inflatable boat in accordance with the first embodiment of the present invention.

Referring to FIGS. 1-7, an inflatable boat in accordance with a first embodiment of the present invention is shown. The inflatable boat of this first embodiment comprises a hull-bottom backing sheet member (1) and a hull-bottom top sheet member (3), a plurality of transom strips (4) bonded between the hull-bottom backing sheet member (1) and the hull-bottom top sheet member (3), and opposing left and right sheet members (2) for constructing left and right air chambers. Each transom strip (4) comprises two opposite curved end portions (41) respectively bonded to respective inner walls of the hull-bottom backing sheet member (1) and the hull-bottom top sheet member (3) and a transversely curved or substantially transversely angled sealing strip (42) sealed to each curved end portion (41) and the hull-bottom backing sheet member (1) or hull-bottom top sheet member (3). The hull-bottom backing sheet member (1) is larger than the hull-bottom top sheet member (3) (see FIG. 3 and FIG. 4). Each of the left and right sheet members (2) has an outer side edge (22) thereof bonded to a top surface of one of two opposite side edges (11) of the hull-bottom backing sheet member (1) and sealed with a respective sealing strip (111), and an opposing inner side edge (21) thereof bonded to a bottom surface of one of two opposite side edges (31) of the hull-bottom top sheet member (3) and internally sealed with a respective sealing strip (112) and externally sealed with a respective sealing strip (221). Further, a sealing strip (222) is sealed to the bonding area between the top surface of the hull-bottom backing sheet member (1) and the bottom surface of each of the two opposite side edges (31) of the hull-bottom top sheet member (3). Thus, opposing left and right lateral air chambers (B) are respectively defined between the left and right sheet members (2) and the hull-bottom backing sheet member (1) outside the hull-bottom top sheet member (3). Because the hull bottom of the inflatable boat is formed of the one-piece hull-bottom backing sheet member (1) and the bonding areas between the two opposite side edges (11) of the hull-bottom backing sheet member (1) and the two opposite outer side edges (22) of the left and right sheet members (2) are disposed above the waterline, the bonded seams between each two adjacent component parts of the inflatable boat will not break even if the bottom of the hull of the inflatable boat is constantly soaked in water. Further, the hull-bottom backing sheet member (1) has a V-cut (12) located in a front side thereof on the middle (see FIG. 1, FIG. 3 and FIG. 4). The internal margin (121) of the V-cut (12) is sealed with a sealing strip (123) to form a V-shaped front piece (A) on the middle of the front side of the hull bottom of the inflatable boat. The rear side of the hull bottom of the inflatable boat is flat. Thus, the V-shaped front piece (A) provides a water/wave-breaking function. The flat rear side of the hull bottom has a shallow draft that will cause less resistance to water. By means of the V-shaped front piece (A) to break water (waves), the inflatable boat can sail in waves rapidly and flexibly (see FIG. 5 and FIG. 6). Further, two pieces of front end fabric (122) are respectively bonded to the two front ends of the V-cut (12) of the hull-bottom backing sheet member (1); two pieces of rear end fabric (23) are respectively bonded to the rear ends of the left and right sheet members (2) and respectively sealed with a respective sealing strip (231). Further, two sealing strips (1221) are installed to seal the two pieces of front end fabric (122) to the front ends of left and right sheet members (2), and thus, the two opposing lateral air chambers (B) are independently and airtightly sealed. Further, a holder frame (6) is transversely connected between the rear ends of the left and right sheet members (2) to hold a driving machine (61).

Figure 8:
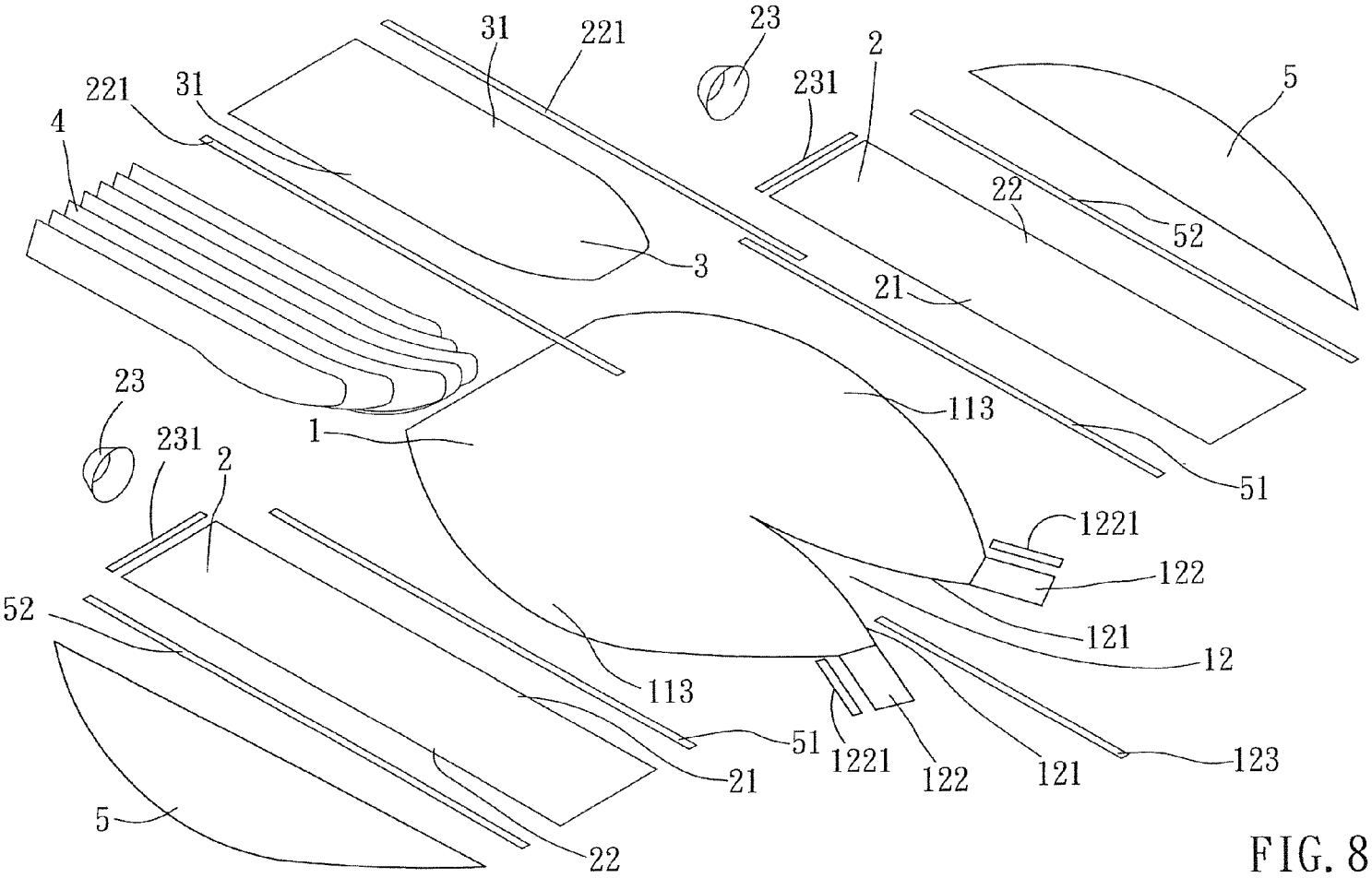
FIG. 8 is an exploded view of an inflatable boat in accordance with a second embodiment of the present invention.
Figure 9:
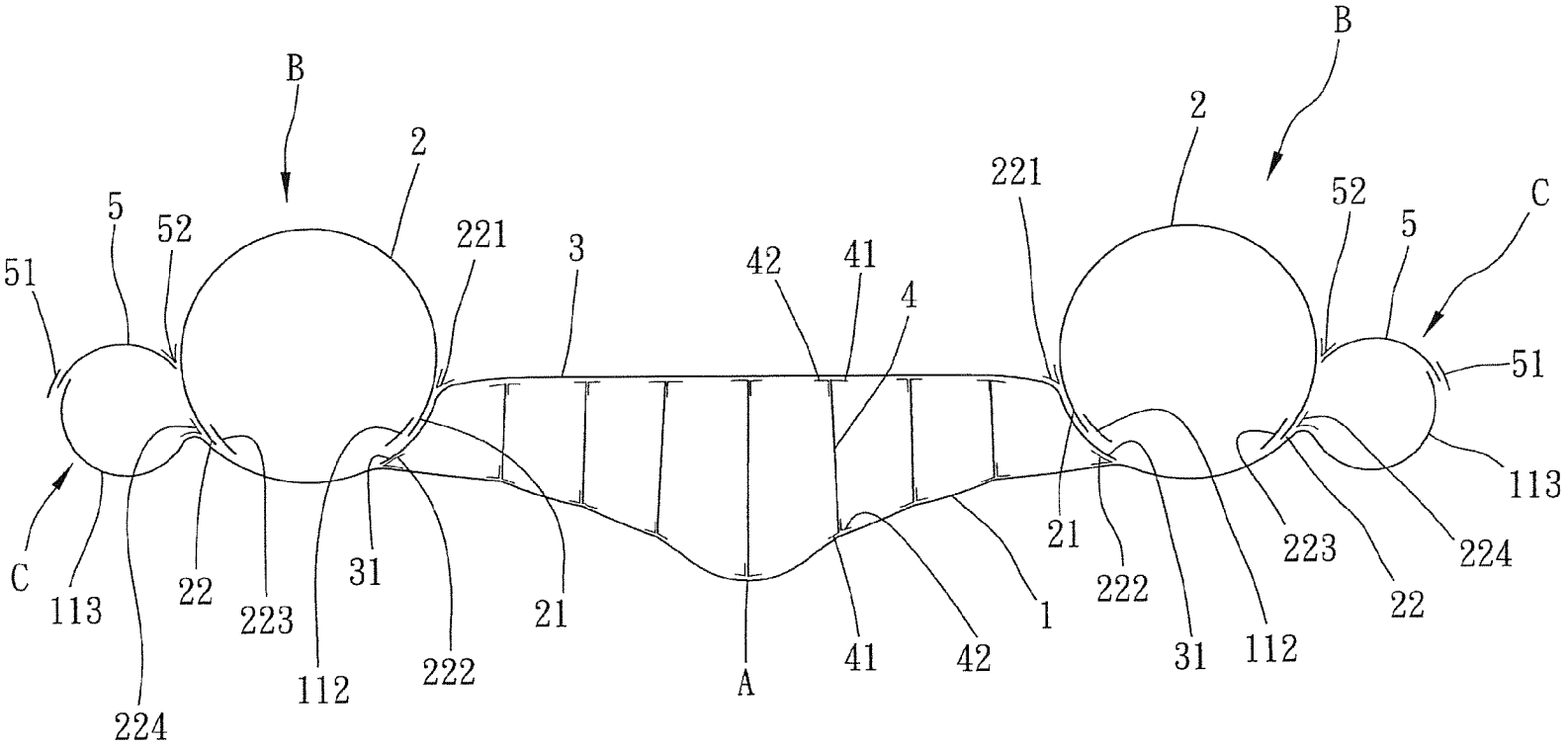
FIG. 9 is a cross sectional view of the inflatable boat in accordance with the second embodiment of the present invention.
Figure 10:
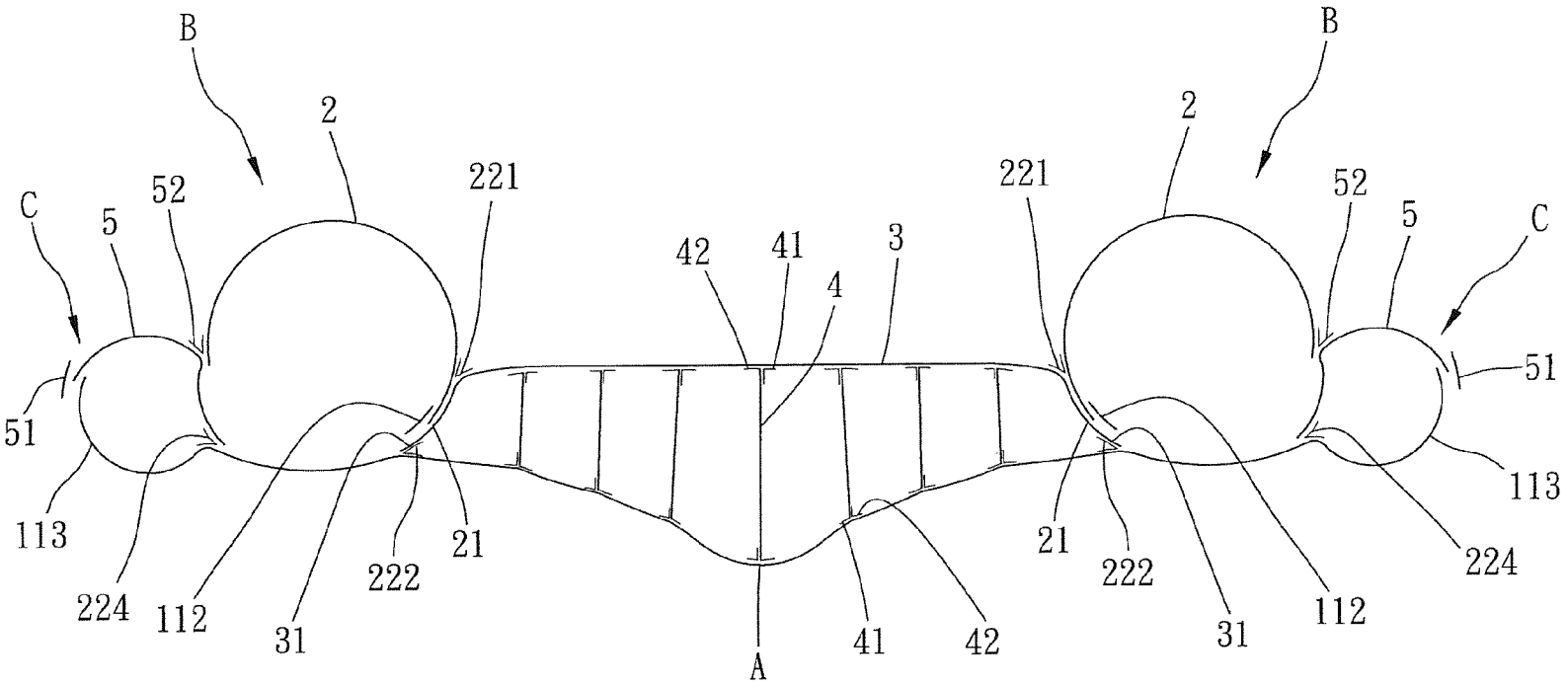
FIG. 10 is a cross sectional view of an alternate form of the inflatable boat in accordance with the second embodiment of the present invention.

Referring to FIGS. 8 and 9, an inflatable boat in accordance with a second embodiment of the present invention is shown. The inflatable boat of this second embodiment comprises a hull-bottom backing sheet member (1) and a hull-bottom top sheet member (3), a plurality of transom strips (4) bonded between the hull-bottom backing sheet member (1) and the hull-bottom top sheet member (3), and opposing left and right sheet members (2) for constructing left and right air chambers. The hull-bottom backing sheet member (1) is larger than the hull-bottom top sheet member (3), having two opposing arched side edges (113). Each of the left and right sheet members (2) has an outer side edge (22) thereof bonded to a top surface of one respective arched side edge (113) of the hull-bottom backing sheet member (1) and internally sealed with a respective sealing strip (223) and externally sealed with a respective sealing strip (224), and an opposing inner side edge (21) thereof bonded to a bottom surface of one respective side edge (31) of the hull-bottom top sheet member (3) and internally sealed with a respective sealing strip (112) and externally sealed with a respective sealing strip (221). Further, a sealing strip (222) is sealed to the bonding area between the top surface of the hull-bottom backing sheet member (1) and the bottom surface of one respective side edge (31) of the hull-bottom top sheet member (3). Thus, opposing left and right lateral air chambers (B) are respectively defined between the left and right sheet members (2) and the hull-bottom backing sheet member (1) outside the hull-bottom top sheet member (3). Further, two sub air chamber top sheet members (5) are respectively bonded between the left and right sheet members (2) and the arched side edges (113) of the hull-bottom backing sheet member (1) outside the lateral air chambers (B). Each sub air chamber top sheet member (5) has one side edge thereof bonded to one respective arched side edge (113) of the hull-bottom backing sheet member (1) and externally sealed with a respective sealing strip (51), and an opposing side edge thereof bonded to the left or right sheet members (2) and sealed with a respective sealing strip (52), and thus, two sub air chambers (C) are formed at two opposite lateral sides relative to the lateral air chambers (B). Because the hull bottom of the inflatable boat is formed of the one-piece hull-bottom backing sheet member (1) and the bonding areas between the two opposite side edges (11) of the hull-bottom backing sheet member (1) and the two opposite outer side edges (22) of the left and right sheet members (2) are disposed above the waterline, the bonded seams between each two adjacent component parts of the inflatable boat will not break even if the bottom of the hull of the inflatable boat is constantly soaked in water. Further, the hull-bottom backing sheet member (1) has a V-cut (12) located in a front side thereof on the middle (see FIG. 8). The internal margin (121) of the V-cut (12) is sealed with a sealing strip (123) to form a V-shaped front piece (A) on the middle of the front side of the hull bottom of the inflatable boat (see FIG. 9). The rear side of the hull bottom of the inflatable boat is flat. Thus, the V-shaped front piece (A) provides a water/wave-breaking function. The flat rear side of the hull bottom has a shallow draft that will cause less resistance to water. By means of the V-shaped front piece (A) to break water (waves), the inflatable boat can sail in waves rapidly and flexibly. Further, two pieces of front end fabric (122) are respectively bonded to the two front ends of the V-cut (12) of the hull-bottom backing sheet member (1); two pieces of rear end fabric (23) are respectively bonded to the rear ends of the left and right sheet members (2) and respectively sealed with a respective sealing strip (231). Further, two sealing strips (1221) are installed to seal the two pieces of front end fabric (122) to the front ends of left and right sheet members (2), and thus, the two opposing lateral air chambers (B) are independently and airtightly sealed. Further, the width of the left and right sheet members (2) can be relatively reduced, and the width of the sub air chamber top sheet members (5) can be relatively increased. Thus, two sub air chamber top sheet members (5) can be respectively bonded between the left and right sheet members (2) and the arched side edges (113) of the hull-bottom backing sheet member (1) outside the lateral air chambers (B) to provide two sub air chambers (C). Each sub air chamber top sheet member (5) has one side edge thereof bonded to one respective arched side edge (113) of the hull-bottom backing sheet member (1) and externally sealed with a respective sealing strip (51), and an opposing side edge thereof bonded to the left or right sheet members (2) and sealed with a respective sealing strip (52), and thus, the desired two sub air chambers (C) are formed at two opposite lateral sides relative to the lateral air chambers (B), as illustrated in FIG. 10.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An inflatable boat, comprising a hull-bottom backing sheet member and a hull-bottom top sheet member, a plurality of transom strips bonded between said hull-bottom backing sheet member and said hull-bottom top sheet member, and left and right sheet members respectively bonded to said hull-bottom backing sheet member and said hull-bottom top sheet member at two opposite lateral sides to form a respective lateral air chamber, wherein said hull-bottom backing sheet member is a one-piece member larger than said hull-bottom top sheet member for forming a hull bottom of the inflatable boat; said left and right sheet members each have an outer side edge thereof bonded to a top surface of one respective side edge of said hull-bottom backing sheet member and sealed with a respective sealing strip, and an opposing inner side edge thereof bonded to a bottom surface of one respective side edge of said hull-bottom top sheet member and internally sealed with a respective sealing strip and externally sealed with a respective sealing strip; the bonding area between the top surface of said hull-bottom backing sheet member and the bottom surface of each side edge of said hull-bottom top sheet member is sealed with a respective sealing strip; the two opposite outer side edges of said left and right sheet members are disposed above the waterline.

2. The inflatable boat as claimed in claim 1, wherein said hull-bottom backing sheet member has a V-cut located in a front side thereof on the middle and an opposing rear side forming a flat rear side of the hull bottom, said V-cut having an internal margin thereof sealed with a sealing strip to form a V-shaped front piece on a middle part of a front side of the inflatable boat to provide a water/wave-breaking function.

3. The inflatable boat as claimed in claim 2, further comprising two pieces of front end fabric respectively bonded to two front ends of said V-cut of said hull-bottom backing sheet member, and two pieces of rear end fabric respectively bonded to respective rear ends of said left and right sheet members and respectively sealed with a respective sealing strip so that the two opposing said lateral air chambers are independently and airtightly sealed.

4. The inflatable boat as claimed in claim 1, further comprising a holder frame transversely connected between respective rear ends of said left and right sheet members to hold a driving machine.

5. An inflatable boat, comprising a hull-bottom backing sheet member and a hull-bottom top sheet member, a plurality of transom strips bonded between said hull-bottom backing sheet member and said hull-bottom top sheet member, left and right sheet members respectively bonded to said hull-bottom backing sheet member and said hull-bottom top sheet member at two opposite lateral sides to form a respective lateral air chamber, and two sub air chamber top sheet members respectively bonded to said left and right sheet members and said hull-bottom backing sheet member to form two sub air chambers at two opposite lateral sides relative to said lateral air chambers, wherein said hull-bottom backing sheet member is larger than said hull-bottom top sheet member, having two opposing arched side edges; said left and right sheet members each have an outer side edge thereof bonded to a top surface of one respective arched side edge of said hull-bottom backing sheet member and internally sealed with a respective sealing strip and externally sealed with a respective sealing strip, and an opposing inner side edge thereof bonded to a bottom surface of one respective side edge of said hull-bottom top sheet member and internally sealed with a respective sealing strip and externally sealed with a respective sealing strip; the bonding area between the top surface of said hull-bottom backing sheet member and the bottom surface of one respective side edge of said hull-bottom top sheet member is sealed with a sealing strip so that the opposing left and right lateral air chambers are respectively defined between said left and right sheet members and said hull-bottom backing sheet member outside said hull-bottom top sheet member; said sub air chamber top sheet members) are respectively bonded between said left and right sheet members and the arched side edges of said hull-bottom backing sheet member outside said lateral air chambers, each said sub air chamber top sheet member having one side edge thereof bonded to one respective arched side edge of said hull-bottom backing sheet member and externally sealed with a respective sealing strip and an opposing side edge thereof bonded to said left or right sheet members and sealed with a respective sealing strip so that two sub air chambers are formed at two opposite lateral sides relative to said lateral air chambers.

6. The inflatable boat as claimed in claim 5, wherein said hull-bottom backing sheet member has a V-cut located in a front side thereof on the middle and an opposing rear side forming a flat rear side of the hull bottom, said V-cut having an internal margin thereof sealed with a sealing strip to form a V-shaped front piece on a middle part of a front side of the inflatable boat to provide a water/wave-breaking function.

7. The inflatable boat as claimed in claim 6, further comprising two pieces of front end fabric respectively bonded to two front ends of said V-cut of said hull-bottom backing sheet member, and two pieces of rear end fabric respectively bonded to respective rear ends of said left and right sheet members and respectively sealed with a respective sealing strip so that the two opposing said lateral air chambers are independently and airtightly sealed.

8. The inflatable boat as claimed in claim 5, wherein the width of said left and right sheet members are relatively reduced; the width of said sub air chamber top sheet members are relatively increased; said two sub air chamber top sheet members are respectively bonded between said left and right sheet members and the arched side edges of said hull-bottom backing sheet member outside said lateral air chambers to provide two sub air chambers; each sub air chamber top sheet member has one side edge thereof bonded to one respective said arched side edge of said hull-bottom backing sheet member and externally sealed with a respective sealing strip, and an opposing side edge thereof bonded to a respective one of said left or right sheet members and sealed with a respective sealing strip so that two desired sub air chambers are formed at two opposite lateral sides relative to said lateral air chambers.

9. The inflatable boat as claimed in claim 5, further comprising a holder frame transversely connected between respective rear ends of said left and right sheet members to hold a driving machine.

* * * * *